US009453185B2

(12) United States Patent
Murphy et al.

(10) Patent No.: US 9,453,185 B2
(45) Date of Patent: Sep. 27, 2016

(54) FABRIC SOFTENER COMPOSITIONS

(71) Applicant: Stepan Company, Northfield, IL (US)

(72) Inventors: Dennis S. Murphy, Libertyville, IL (US); Christopher A. Gariepy, Northbrook, IL (US); Carmen Matache, Mount Prospect, IL (US); Daniel Bertholf, Glenview, IL (US)

(73) Assignee: Stepan Company, Northfield, IL (US)

( * ) Notice: Subject to any disclaimer, the term of this patent is extended or adjusted under 35 U.S.C. 154(b) by 28 days.

(21) Appl. No.: 14/464,574

(22) Filed: Aug. 20, 2014

(65) Prior Publication Data

US 2014/0366282 A1 Dec. 18, 2014

Related U.S. Application Data

(63) Continuation of application No. PCT/US2013/026692, filed on Feb. 19, 2013.

(60) Provisional application No. 61/601,121, filed on Feb. 21, 2012.

(51) Int. Cl.

| | |
|---|---|
| ***C11D 3/37*** | (2006.01) |
| ***C11D 3/00*** | (2006.01) |
| ***C11D 1/62*** | (2006.01) |
| ***C11D 3/04*** | (2006.01) |

(52) U.S. Cl.
CPC ..... *C11D 3/0015* (2013.01); *C11D 1/62* (2013.01); *C11D 3/046* (2013.01)

(58) Field of Classification Search
CPC ..... C11D 1/62; C11D 3/0015
See application file for complete search history.

(56) References Cited

U.S. PATENT DOCUMENTS

| | | | | |
|---|---|---|---|---|
| 5,637,743 | A | 6/1997 | Contet et al. | |
| 5,750,492 | A | 5/1998 | Contet et al. | |
| 5,856,287 | A | 1/1999 | Motyka | |
| 6,180,594 | B1 | 1/2001 | Fender et al. | |
| 2004/0076829 | A1* | 4/2004 | Levinson | C11D 3/001 428/411.1 |
| 2006/0037150 | A1 | 2/2006 | Offord et al. | |
| 2006/0089293 | A1 | 4/2006 | Frankenbach | |
| 2006/0264352 | A1 | 11/2006 | Sajic et al. | |
| 2007/0054835 | A1 | 3/2007 | Corona, III et al. | |
| 2009/0054297 | A1 | 2/2009 | Mohammadi | |
| 2011/0219730 | A1 | 9/2011 | Corona, III et al. | |
| 2011/0239378 | A1 | 10/2011 | Fossum et al. | |
| 2011/0245140 | A1 | 10/2011 | Demeyere | |

FOREIGN PATENT DOCUMENTS

| | | | |
|---|---|---|---|
| DE | 4243701 | A1 | 6/1994 |
| EP | 580527 | A1 * | 1/1994 |
| IT | MI-2008-A-1859 | | 10/2008 |
| WO | WO2011/120822 | | 10/2011 |
| WO | WO2011/120836 | | 10/2011 |
| WO | WO2011/123284 | | 10/2011 |
| WO | WO2011/123606 | | 10/2011 |
| WO | WO2011/123733 | | 10/2011 |

OTHER PUBLICATIONS

International Search Report and Written Opinion dated Apr. 18, 2013 for PCT Application No. PCT/US2013/026692 filed Feb. 19, 2013.

* cited by examiner

*Primary Examiner* — John Hardee
(74) *Attorney, Agent, or Firm* — McAndrews, Held & Malloy, Ltd.

(57) ABSTRACT

Low-viscosity liquid fabric softening compositions are disclosed that comprise a fabric softener active system that contains at least one ammonium fabric softener compound and less than 8% added solvent. The fabric softening compositions have a Dispersion Parameter that is less than 100, provided the fabric softening active system has a viscosity of less than 2000 cP at 80° C. and the fabric softening composition has an initial viscosity of less than 400 cP. A method of preparing the liquid fabric softening composition and a method of softening fabric articles with the liquid fabric softening composition are also disclosed.

8 Claims, No Drawings

FABRIC SOFTENER COMPOSITIONS

RELATED APPLICATIONS

This application claims priority to, and is a continuation of, International application No. PCT/US2013/026692 (International Publication No. WO 2013/126335), having an International filing date of Feb. 19, 2013. The PCT application claims priority to and claims benefit from U.S. provisional patent application No. 61/601,121, having a filing date of Feb. 21, 2012. The entire specifications of the PCT and provisional applications referred to above are hereby incorporated by reference.

FIELD OF THE INVENTION

The present invention relates to fabric treatment compositions and methods of using and making the same.

BACKGROUND OF THE INVENTION

Virtually all fabric softener actives in the market place intended for use in liquid dispersions are sold with at least 9% added solvent. For example, Armosoft® DEQ and Arquad® 2HT-75 from Akzo Nobel are 20% and 25%, respectively, of added solvent; the STEPANTEX series and ACCOSOFT series of softener actives from Stepan Co. have 10% added solvent; ADOGEN® 442 and REWOQUAT® WE-18 from Evonik Industries are 25% and 10%, respectively, of added solvent. The conventional thinking is that significant solvent must be added to the fabric softener active to achieve acceptable concentrated aqueous dispersions (F. E. Friedli., et al. *J. of Surfactants and Detergents*, Vol. 5, No. 3, 2002, page 212) as well as having a product which will have a low enough viscosity in its molten state in order to be moved with conventional pumps while not having to heat it to too high a temperature such that it might decompose. The added solvent is usually a VOC (isopropanol or ethanol) which can ultimately get into the atmosphere and contribute to smog formation. In addition, more fossil fuel needs to be burned in transporting a given amount of fabric softener active than a situation when the amount of added solvent used is reduced or eliminated. If fabric softener actives with reduced or no added solvent can be produced which melt at an acceptable temperature, can easily be pumped while in the molten state, and can be used to make low-viscosity, stable aqueous fabric softener dispersions, there will be economic and environmental benefits.

In U.S. Pat. Nos. 5,637,743 and 5,750,492 (both have the same specification), in spite of the fact that in column 6 the patents state "... a softening composition is obtained which has proved to be directly usable ...," they teach solvent usage in examples 9-15 by demonstrating that a lower cloud temperature than ">80° C." can be obtained by adding solvent/additive (compound II is referred to as a solvent at the end of Example 8). Indeed, in the examples where aqueous dispersions are made (13-15), in every case the active quat is mixed with 10% isopropanol solvent prior to dispersing in water. It seems the meaning of "directly usable" in column 6 is that no further processing steps are required such as separating out the alkyl glycerides—clearly the patent teaches away from as is usage of the reaction mixture for making the aqueous dispersions as in every example, at least 10% solvent or additive is employed.

In U.S. Patent Publication No. 2006/0089293 compositions which can be directly added to water are described.

However, in all 9 examples provided in Example 1, the fabric softener active composition is at least 25% of added solvent.

In U.S. Patent Publication Nos. 2007/0054835 and 2011/0219730, compositions which can be dispersed directly into water are described. However, in the example provided, a diluent is added to the fabric softener active during synthesis in an amount that the fabric softener composition is 10% added diluent—also, during the production of the aqueous dispersion, the aqueous mixture is heated to at least 80° C. in all the examples provided.

In WO 2011/123284, a fabric softener active is disclosed which the application states can be added directly to water in the absence of solvent to create the dispersion. However, the water must be heated to 70° C. which is relatively high and requires considerable energy to achieve. In WO 2011/123733 and WO 2011/120822, the same fabric softener active as in WO 2011/123284 is disclosed, along with the same claim to be able to be directly added to water to create the dispersion, but the temperature at which the water must be held is not disclosed. WO 2011/123606 and WO 2011/120836 also disclose the use of low solvent-containing fabric softener active systems but the only example illustrating the low-solvent fabric softener active composition has a solvent amount of 8% by weight.

In Italian patent application number 2008/1859A, a fabric softening composition is described which does not use solvent. However, it is provided in solid (flake) form which is added directly to water without melting it first and therefore has the drawback of having to use special solid handling equipment for the fabric softener active material.

Thus, there is a need for a fabric softener active system which has reduced or no added solvent. There is also a need that the fabric softener active can flow without having to heat it to very high temperatures. There is also a need that stable, low-viscosity, liquid fabric softener dispersions made from the fabric softener active can be made using standard existing processes known to those skilled in the art.

SUMMARY OF THE INVENTION

It has surprisingly been found that stable, low-viscosity liquid fabric softener compositions can be formulated using fabric softener active systems containing less than 8% added solvent.

In a first aspect of the present technology, the liquid fabric softening composition comprises:

a. from 1% to 30% of a quaternary ammonium fabric softener active system comprising at least one quaternary ammonium fabric softening compound and less than 8% added solvent;

b. from 0% to 2% of an electrolyte concentration aid; and c. a liquid carrier;

wherein, the composition has a Dispersion Parameter that is less than 100, provided that the fabric softener active system has a viscosity of less than 2000 cP at 80° C., and the liquid fabric softening composition has an initial viscosity of less than 400 cP; and, the temperature of the liquid carrier during production of the composition is maintained at 65° C. or less.

In a second aspect, the present technology is directed to a method for conditioning textiles comprising the steps of:

a. providing a liquid fabric softener composition comprising a fabric softener active system that comprises less than 8% by weight added solvent, wherein the composition is provided in a concentration sufficient to soften and condition fabrics under predetermined laundering conditions;

b. contacting one or more articles with the composition at one or more points during a laundering process; and c. allowing the articles to dry or mechanically tumble-drying them.

In a further aspect, the present technology is directed to a method of making a liquid fabric softening composition comprising the steps of:

a. providing a molten quaternary ammonium fabric softener active system comprising at least one quaternary ammonium fabric softening compound and less than 8% by weight of added solvent, based on the weight of the fabric softener active system;

b. heating a liquid carrier to a temperature in the range of about 45° C. to about 65° C.;

c. mixing 1 to 30% by weight of the molten fabric softener active system into the heated liquid carrier; and d. allowing the mixture to cool.

BRIEF DESCRIPTION OF SEVERAL VIEWS OF THE DRAWINGS

[Not Applicable]

DETAILED DESCRIPTION OF THE INVENTION

While the presently described technology will be described in connection with one or more preferred embodiments, it will be understood by those skilled in the art that the technology is not limited to only those particular embodiments. To the contrary, the presently described technology includes all alternatives, modifications, and equivalents as may be included within the spirit and scope of the appended claims.

DEFINITIONS

"Quaternary ammonium fabric softener compound" is defined as the entire mass of the material in the reaction vessel after the reaction between the raw materials has been terminated.

"Fabric softener active system" is defined as the quaternary ammonium fabric softener compound plus any added solvent—if no solvent is added to the quaternary ammonium fabric softener compound, then the fabric softener active system is just the quaternary ammonium fabric softener compound itself.

Quaternary Ammonium Fabric Softener Compounds

Quaternary ammonium fabric softener compounds contemplated for use herein include esterquats having at least two or more $C_{12-28}$ alkyl or alkenyl groups connected to the molecule via at least one ester link. It is more preferred that the quaternary ammonium compound have two or more ester links present. Suitable ester linked quaternary ammonium compounds can be represented by the formula:

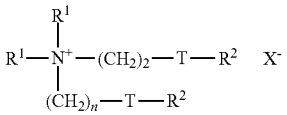

wherein each $R^1$ group is independently selected from $C_{1-4}$ alkyl, hydroxyalkyl (e.g. hydroxyethyl) or $C_{2-4}$ alkenyl groups; and wherein each $R^2$ group is independently selected from $C_{8-28}$ alkyl or alkenyl groups; T is

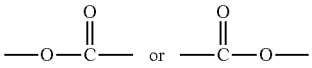

$X^-$ is any suitable anion such as, for example, halide, methyl sulfate or ethyl sulfate radicals, or mixtures thereof, and n is 0 or an integer from 1-5.

The esterquats can be prepared by esterifying fatty acids, their methyl esters, or triglycerides with alkanolamines, followed by quaternization of the resultant esteramine with an alkylating agent.

Suitable fatty acids, or methyl esters/triglycerides thereof, for use in preparing the fabric softening active are $C_{12-28}$ fatty acids that are saturated or unsaturated, or mixtures thereof. The fatty acids typically comprise a mixture of chain lengths, but an average chain length of from 16 to 18 carbons is preferred. The fatty acids are preferably either non-hydrogenated or partially hydrogenated, and have an Iodine value in the range of 25 to 125, alternatively in the range of 35 to 70. The fatty acids may be derived from various sources such as, for example, tallow, soy, palm, palm kernel, rape seed, sunflower, corn, canola, lard, or mixtures thereof.

The fabric softening active may also be prepared by direct esterification of alkanolamines with triglycerides, as disclosed, for example, in U.S. Pat. No. 5,750,492 to Contet et al., which is hereby incorporated by reference in its entirety. The triglycerides may be obtained from various sources such as, for example, tallow, palm oil, soybean oil, palm kernel oil, rape seed oil, sunflower oil, lard, or mixtures thereof.

The alkanolamines useful in preparing the fabric softening active generally correspond to the following general formula:

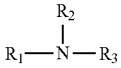

where $R_1$, $R_2$ and $R_3$ are independently selected from $C_1$-$C_6$ alkyl or hydroxy alkyl groups. Suitable alkanolamines include triethanol amine (TEA), methyl diethanolamine (MDEA), ethyl diethanolamine, dimethyl amino-N-(2,3-propanediol), diethylamino-N-(2,3-propanediol), methylamino-N,-N,-bis(2,3-propanediol), and ethylamino-N,N,-bis(2,3-propanediol) and mixtures thereof. The molar ratio of fatty acid/fat to alkanolamine is generally in the range of 1.45:2.15, preferably in the range of 1.55:1.75.

Preferred esterquats are the TEA-based esterquats. MDEA-based esterquats are less preferred because their excellent packing leads to more crystallization and the need for higher temperatures in order to melt them.

Processes for preparing the esteramines and subsequent quaternization to form the esterquats are known in the art. Such processes are disclosed, for example, in U.S. Pat. No. 6,037,315 to Franklin et al., U.S. Pat. No. 5,574,179 to Wahl et al., and U.S. Pat. No. 5,750,492 to Contet et al., which are hereby incorporated by reference in their entirety.

The quaternary ammonium fabric softener compounds may also be amidoamine/diamidoamine quats having at least one $C_{12}$-$C_{28}$ alkyl or alkenyl group connected to the molecule via at least one amide link. It is more preferred that the quaternary ammonium compound have at least two amide links present. The diamidoamine quats can be represented by the following formula:

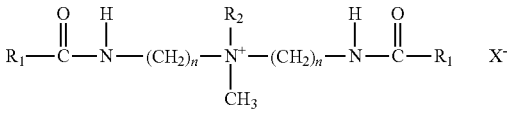

where each $R_1$ group is independently selected from $C_{12}$-$C_{28}$ alkyl or alkenyl groups, $R_2$ is methyl, ethyl or $(C_nH_{2n}O)_xH$, n is 1-3, x is from 1 to about 5 and $X^-$ is any suitable anion such as, for example, halide, methyl sulfate or ethyl sulfate radicals, or mixtures thereof.

It should be understood that the quaternary ammonium fabric softener compound comprises a mixture of mono-, di- and tri-ester components having varying chain lengths, or a mixture of amidoamine/diamidoamine components having varying chain lengths. The cationic species in the quaternary ammonium fabric softener compound which is present in the greatest amount on a weight percent basis relative to all the cationic species present preferably contains two alkyl chains with 12 or more carbon atoms each.

Solvents

The term "solvent" used herein includes any additive/diluent intentionally added to reduce viscosity of the quaternary ammonium fabric softener compound fabric softener active and/or increase its water dispersibility from the molten state. Solvents useful in the present technology include ethanol, isopropanol, glycerol, other C1-C6 alcohols, monoglycerides, diglycerides, triglycerides, fatty acids and combinations thereof. Compositions covered by the present technology contain 8% or less, more preferably, 5% or less, even more preferably 3% or less and most preferably no added solvent. Alternatively, compositions covered by the present technology contain less than 8% added solvent, more preferably, less than 5% added solvent, even more preferably less than 3% added solvent and most preferably no added solvent.

Electrolyte Concentration Aids

Inorganic electrolytes include ionizable salts which can also optionally be incorporated into the compositions of the present technology. They are typically used in more concentrated dispersions to control viscosity of the dispersion but do not guarantee in the present technology that a stable dispersion with an initial viscosity less than 400 cP will be produced as evidenced by Formulation 8 in the Example 3 below. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Liquid Carrier

The liquid carrier employed in the instant compositions is preferably at least primarily water due to its low cost, relative availability, safety, and environmental compatibility.

Mixtures of water and low molecular weight, for example, less than 100 Daltons, alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Adjunct Ingredients

Adjunct ingredients may be added to the compositions of the present technology. The term "adjunct ingredient" includes: dispersing agents, stabilizers, pH control agents, metal ion control agents, colorants, brighteners, dyes, odor control agent, pro-perfumes, cyclodextrin, perfume, solvents, soil release polymers, preservatives, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, antimicrobials, drying agents, stain resistance agents, soil release agents, malodor control agents, fabric refreshing agents, chlorine bleach odor control agents, dye fixatives, dye transfer inhibitors, color maintenance agents, color restoration, rejuvenation agents, anti-fading agents, whiteness enhancers, anti-abrasion agents, wear resistance agents, fabric integrity agents, anti-wear agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, and combinations thereof. The adjunct components may be added to the fabric softener compositions in an amount of 0 to about 3% by weight of the composition.

Methods of Making Fabric Softener Dispersions

Making the liquid fabric softener composition entails slowly mixing the molten quaternary ammonium fabric softening compound which is at a temperature of 80° C. or less into the liquid carrier, preferably water, which has been heated to about 65° C. or less, preferably in the range of 30° C. to 65° C., with agitation. The dispersion is then mixed for several minutes, and the electrolyte concentration aid, if used in the given formula, is added. The dispersion is then mixed for several minutes more while it is allowed to cool to room temperature. Although the dispersion could be made by other procedures known to those of skill in the art, the presently described procedure is advantageous because the water used in making the dispersion can be heated to a lower temperature, requiring less energy input, yet still be effective to mix and form the dispersion.

As the temperature of the fabric softener active system is increased, viscosity decreases. Therefore, 80° C. will be the point of lowest viscosity yet at the maximum temperature which will still minimize chemical degradation in storage. If the Dispersion Parameter criterion are met, yet the viscosity of the fabric softener active system is low enough that the fabric softener active system can be moved with conventional pumps at temperatures below 80° C., it is understood that heating and holding the fabric softener active system at 80° C. is not a requirement to practice the present technology and that holding the fabric softener active system at temperatures lower than 80° C. prior to forming the fabric softener composition is within the scope of the present technology.

Methods of Using Fabric Softener Compositions

The fabric softening compositions of the present technology are suitable for use in the rinse cycle of a laundry process, in particular, the rinse cycle of a domestic or industrial automatic laundry washing machine or a hand washing laundry rinse basin. For example, the fabric softening composition can be dispensed from a fabric softener dispenser that is integral to the automatic laundry washing machine at the appropriate time during the laundry process. The fabric softening composition is added to the dispenser in an amount effective to soften and condition fabric articles under predetermined laundering conditions. At one or more points during the laundering process, the fabric softening composition is dispensed from the dispenser and contacts the fabric articles to soften and condition the fabrics. Following the laundering process, the fabric articles are allowed to dry or are mechanically tumbled dry.

Alternatively, the fabric softening composition can be used in a hand washing laundry process wherein the fabric softening composition is added to one or more rinse bath solutions for manually rinsing fabric articles in a hand washing laundry process. The fabric softening composition is added to the rinse bath solution in an amount effective to soften and condition the fabric articles. Following the laundering process, the fabric articles are allowed to dry or are mechanically tumbled dry.

The following examples will more fully illustrate the embodiments of the present technology. All parts, percentages and proportions referred to herein and in the appended claims are by weight unless otherwise illustrated. Physical test methods are described below.

EXAMPLES

Dispersion Parameter (DP)=[(viscosity of molten quat at 80° C. in cP)(initial viscosity of aqueous dispersion in cP)]/8000 $cP^2$ Above 80° C., the quaternary ammonium compounds in the fabric softener active systems can experience accelerated chemical breakdown. Above about 2000 centipoise (cP), the fabric softener active system becomes too viscous to be pumped around using conventional pumps. Above about 400 cP initial viscosity of the liquid dispersions, they tend to exhibit unacceptable thickening in storage. Therefore, compositions with DP values less than 100 are within the scope of the present technology with the proviso that the fabric softener active system has a viscosity less than 2000 cP at 80° C., and the initial viscosity of the composition is less than 400 cP.

Viscosity measurements on the fabric softener active systems samples were taken on an Advanced Rheometer model number AR 2000 at a shear rate of 10/sec.

Liquid compositions were made by heating water from 30° C. to 65° C. in a glass beaker equipped with an Ika Eurostar mixer and blade with a 2.5" diameter. Molten fabric softener active system was then added while agitation between 350-400 rpm was started. After mixing for 5 minutes, $CaCl_2$ was added while the mixing speed was reduced to 200 rpm. The dispersion was then air cooled with mixing for 15 minutes.

Viscosity measurements on the finished liquid compositions were taken on a Brookfield DV-II+ Pro Viscometer with an RVT spindle #4 at 50 rpm.

Example 1

A quaternary ammonium fabric softening compound was made by reacting soft tallow triglyceride with triethanolamine (TEA) at a ratio of 1.55 parts fat (fat is defined as one hydrocarbon chain on the triglyceride) to 1 part TEA and then quaternizing with a 0.95 molar quantity of dimethylsulfate (DMS) relative to the esteramine. No solvent was added to the reaction product. The measured viscosity of the fabric softener active system at 80° C. was 520 cP.

The fabric softener active system was formulated into fabric softening composition formulations 1 and 2 comprising the fabric softener active system, a liquid carrier, and, optionally, an electrolyte concentration aid. The amounts of each component and the viscosity and DP properties of each formulation are shown in the table below.

| | Formulation | |
|---|---|---|
| Ingredient/Property | 1 | 2 |
| Quaternary Ammonium Fabric Softener Compound (%) | 5.0 | 26.5 |
| Calcium Chloride (%) | 0 | 0.35 |
| Water (%) | 95 | 73.15 |
| Viscosity (cP) | 140 | 70 |
| Dispersion Parameter | 3.5 | 1.8 |

Formulations 1 and 2 are examples of compositions which fall within the scope of the present technology.

Example 2

A quaternary ammonium fabric softening compound was made by reacting a mixture of 85% soft tallow triglyceride and 15% hard tallow triglyceride with TEA at a ratio of 1.55 parts fat (fat is defined as one hydrocarbon chain on the triglyceride) to 1 part TEA and then quaternizing with DMS. No solvent was added to the reaction product. The measured viscosity of the fabric softener active system at 80° C. was 308 cP.

The fabric softener active system was formulated into fabric softening composition formulations 3-5 comprising the fabric softener active system, a liquid carrier, and optionally, an electrolyte concentration aid. The amounts of each component and the viscosity and DP properties for each formulation are shown in the table below.

| | Formulation | | |
|---|---|---|---|
| Ingredient/Property | 3 | 4 | 5 |
| Quaternary Ammonium Fabric Softener Compound (%) | 5.0 | 16.5 | 26.5 |
| Calcium Chloride (%) | 0 | 0.25 | 0.35 |
| Water (%) | 95 | 83.25 | 73.15 |
| Viscosity (cP) | 50 | 60 | 96 |
| Dispersion Parameter | 1.9 | 2.3 | 3.7 |

Formulations 3-5 are examples of compositions which fall within the scope of the present technology.

Example 3

A quaternary ammonium fabric softening compound was made by reacting a mixture of 50% soft tallow triglyceride and 50% hard tallow triglyceride with TEA at a ratio of 1.55 parts fat (fat is defined as one hydrocarbon chain on the triglyceride) to 1 part TEA and then quaternizing with DMS. No solvent was added to the reaction product. The measured viscosity of the fabric softener active system at 80° C. was 750 cP.

The fabric softener active system was formulated into fabric softening composition formulations 6-8 comprising the fabric softener active system, a liquid carrier and optionally, an electrolyte concentration aid. The amounts of each component and the viscosity and DP properties for each formulation are shown in the table below.

| Ingredient/Property | Formulation 6 | 7 | 8 |
|---|---|---|---|
| Quaternary Ammonium Fabric Softener Compound (%) | 5.0 | 11.0 | 16.5 |
| Calcium Chloride (%) | 0 | 0.20 | 0.25 |
| Water (%) | 95 | 88.80 | 83.25 |
| Viscosity (cP) | 32 | 196 | >3000 |
| Dispersion Parameter | 3.0 | 18.4 | >100 |

Formulations 6 and 7 are examples of compositions which fall within the scope of the present technology. Formulation 8 is an example of a composition not within the scope of the present technology since its initial viscosity is above 400 cP and its DP is above 100.

Example 4

A quaternary ammonium fabric softening compound was made by reacting hard tallow triglyceride with triethanolamine (TEA) at a ratio of 1.55 parts fat (fat is defined as one hydrocarbon chain on the triglyceride) to 1 part TEA and then quaternizing with a 0.95 molar quantity of dimethylsulfate (DMS) relative to the esteramine. No solvent was added to the reaction product. The measured viscosity of the fabric softener active system at 80° C. was 1839 cP.

The fabric softener active system was formulated into fabric softening composition formulations 9-10 comprising the fabric softener active system, a liquid carrier, and optionally, an electrolyte concentration aid. The amounts of each component and the viscosity and DP properties for each formulation are shown in the table below.

| Ingredient/Property | Formulation 9 | 10 |
|---|---|---|
| Quaternary Ammonium Fabric Softener Compound (%) | 5.0 | 11.0 |
| Calcium Chloride (%) | 0 | 0.20 |
| Water (%) | 95 | 88.80 |
| Viscosity (cP) | 10 | >3000 |
| Dispersion Parameter | 2.3 | >100 |

Formulation 9 is an example of a composition which falls within the scope of the present technology. Formulation 10 is an example of a composition which is not within the scope of the present technology since its initial viscosity is above 400 cP and its DP is above 100.

Example 5

A quaternary ammonium fabric softening compound was made by reacting a mixture of 50% soft tallow triglyceride and 50% hard tallow triglyceride with TEA at a ratio of 1.55 parts fat (fat is defined as one hydrocarbon chain on the triglyceride) to 1 part TEA and then quaternizing with DMS. An amount of isopropanol solvent was added to the quaternary ammonium fabric softener compound such that the fabric softener active system was 95% quaternary ammonium fabric softening compound and 5% isopropanol. The measured viscosity of the fabric softener active system at 80° C. was 194 cP.

The fabric softener active system was formulated into fabric softening composition formulation 11 shown in the table below.

| Ingredient/Property | Formulation 11 |
|---|---|
| Quaternary Ammonium Fabric Softener Compound (%) | 16.5 |
| Isopropanol (%) - from the fabric softener active system | 0.87 |
| Calcium Chloride (%) | 0.25 |
| Water (%) | 82.38 |
| Viscosity (cP) | 368 |
| Dispersion Parameter | 8.9 |

Formulation 11 is an example of a composition which falls within the scope of the present technology.

Example 6

The fabric softener active systems in this example all have viscosities above 2000 cP at 80° C. and are therefore representative of fabric softener active systems not within the scope of the present technology.

A. A quaternary ammonium fabric softening compound made by reacting soft tallow fatty acid with TEA at a ratio of 1.55 parts fatty acid to 1 part TEA and then quaternizing with a 0.95 molar quantity of DMS relative to the esteramine. No solvent was added to the reaction product. The measured viscosity of the fabric softener active system at 80° C. was 3749 cP.

B. A quaternary ammonium fabric softening compound made by reacting a mixture of 85% soft tallow fatty acid and 15% hard tallow fatty acid with TEA at a ratio of 1.55 parts fatty acid to 1 part TEA and then quaternizing with a 0.95 molar quantity of DMS relative to the esteramine. No solvent was added to the reaction product. The measured viscosity of the fabric softener active system at 80° C. was 5340 cP.

C. The quaternary ammonium fabric softening compound from B where an amount of isopropanol solvent was added to the quaternary ammonium fabric softener compound such that the fabric softener active system was 97% quaternary ammonium fabric softening compound and 3% isopropanol. The measured viscosity of the fabric softener active system at 80° C. was 2478 cP.

D. A quaternary ammonium fabric softening compound made by reacting a mixture of 85% soft palm fatty acid and 15% hard palm fatty acid with TEA at a ratio of 1.55 parts fatty acid to 1 part TEA and then quaternizing with a 0.95 molar quantity of DMS relative to the esteramine. No solvent was added to the reaction product. The measured viscosity of the fabric softener active system at 80° C. was 3528 cP.

Example 7

A quaternary ammonium fabric softening compound made by reacting soft tallow fatty acid with TEA at a ratio of 1.55 parts fatty acid to 1 part TEA and then quaternizing with a 0.95 molar quantity of DMS relative to the esteramine. An amount of isopropanol solvent was added to the quaternary ammonium fabric softener compound such that the fabric softener active system was 95% quaternary ammonium fabric softening compound and 5% isopropanol. The measured viscosity of the fabric softener active system at 80° C. was 380 cP.

The fabric softener active system was formulated into fabric softening composition formulation 12 shown in the table below.

| Ingredient/Property | Formulation 12 |
|---|---|
| Quaternary Ammonium Fabric Softener Compound (%) | 16.5 |
| Isopropanol (%) - from the fabric softener active system | 0.87 |
| Calcium Chloride (%) | 0.25 |
| Water (%) | 82.38 |
| Viscosity (cP) | 12 |
| Dispersion Parameter | 0.57 |

Formulation 12 is an example of a composition which falls within the scope of the present technology.

Example 8

A quaternary ammonium fabric softening compound made by reacting a mixture of 85% soft palm fatty acid and 15% hard palm fatty acid with TEA at a ratio of 1.55 parts fatty acid to 1 part TEA and then quaternizing with a 0.95 molar quantity of DMS relative to the esteramine. An amount of isopropanol solvent was added to the quaternary ammonium fabric softener compound such that the fabric softener active system was 95% quaternary ammonium fabric softening compound and 5% isopropanol. The measured viscosity of the fabric softener active system at 80° C. was 525 cP.

The fabric softening active system was formulated into fabric softening composition formulation 13 shown in the table below.

| Ingredient/Property | Formulation 13 |
|---|---|
| Quaternary Ammonium Fabric Softener Compound (%) | 16.5 |
| Isopropanol (%) - from the fabric softener active system | 0.87 |
| Calcium Chloride (%) | 0.25 |
| Water (%) | 82.38 |
| Viscosity (cP) | 16 |
| Dispersion Parameter | 1.1 |

Formulation 13 is an example of a composition which falls within the scope of the present technology.

The present technology is now described in such full, clear and concise terms as to enable a person skilled in the art to which it pertains, to practice the same. It is to be understood that the foregoing describes preferred embodiments of the present technology and that modifications may be made therein without departing from the spirit or scope of the present technology as set forth in the appended claims. Further the examples are provided to not be exhaustive but illustrative of several embodiments that fall within the scope of the claims.

What is claimed is:

1. A method of making a liquid fabric softening composition comprising the steps of:

a. providing a molten quaternary ammonium fabric softener active system comprising (i) at least one esterquat quaternary ammonium fabric softening compound, wherein the esterquat component is the quaternized reaction product of triethanolamine reacted with a triglyceride at a molar ratio of fat to triethanolamine in the range of 1.55 to 1.75, where fat is defined as one hydrocarbon chain on the triglyceride, and (ii) 5% or less by weight of added solvent, based on the weight of the fabric softener active system, wherein the fabric softener active system has a viscosity of less than 2,000 cps at 80° C.;

b. heating water to a temperature in the range of about 30° C. to about 65° C.;

c. mixing from 1% to 30% by weight, based on the weight of the fabric softening composition, of the molten fabric softener active system into the heated water; and d. allowing the mixture to cool, wherein the fabric softener composition has an initial viscosity of less than about 400 cP and a Dispersion Parameter that is less than 100.

2. The method of claim 1, wherein the fabric softener active system comprises 3% or less added solvent.

3. The method of claim 1, wherein the fabric softener active system comprises no added solvent.

4. The method of claim 1, further comprising mixing up to 2% by weight, based on the weight of the fabric softening composition, of an electrolyte concentration aid into the heated water.

5. The method of claim 1, wherein the water is heated to a temperature of 45° C. to 65° C.

6. The method of claim 1, wherein the amount of the fabric softener active system mixed into the heated water is from 5% to 30% by weight.

7. A liquid fabric softening composition comprising:

(a) from 1% to 30% by weight of a fabric softener active system comprising:

(i) an esterquat component that is the quaternized reaction product of triethanolamine (TEA) reacted with triglyceride, at a molar ratio of fat to TEA of 1.55 to 1.75, where fat is defined as one hydrocarbon chain on the triglyceride; and (ii) 5% or less by weight of added solvent, based on the weight of the fabric softener active system;

wherein the fabric softener active system has a viscosity of less than 2000 cP at 80° C.;

(b) from 0% to 2% of an electrolyte concentration aid; and (c) water;

wherein the liquid fabric softening composition has a Dispersion Parameter that is less than 100, provided that the fabric softener active system has a viscosity of less than 2000 cP at 80° C., and the fabric softening composition has an initial viscosity that is less than 400 cP.

8. The liquid fabric softening composition of claim 7, wherein the amount of added solvent is 3% or less.

* * * * *